US006845517B2

(12) United States Patent
Aldridge et al.

(10) Patent No.: US 6,845,517 B2
(45) Date of Patent: Jan. 25, 2005

(54) VENTED PROTECTIVE GARMENT

(75) Inventors: Donald Aldridge, New Carlisle, OH (US); Nicholas J. Curtis, Dayton, OH (US); Harold Oakley, West Liberty, KY (US)

(73) Assignee: Lion Apparel, Inc., Dayton, OH (US)

( * ) Notice: Subject to any disclaimer, the term of this patent is extended or adjusted under 35 U.S.C. 154(b) by 0 days.

(21) Appl. No.: 10/360,035

(22) Filed: Feb. 7, 2003

(65) Prior Publication Data

US 2004/0154084 A1 Aug. 12, 2004

(51) Int. Cl.[7] ..... A41D 11/00
(52) U.S. Cl. ..... 2/81
(58) Field of Search ..... 2/69, 81, 82, 87, 2/93, 97, 243 R, 272; 428/166, 178, 920

(56) References Cited

U.S. PATENT DOCUMENTS

| | | | | | |
|---|---|---|---|---|---|
| 3,045,243 | A | | 7/1962 | Lash et al. | |
| 3,086,215 | A | | 4/1963 | Di Paola | |
| 3,296,626 | A | | 1/1967 | Ludwikowski | |
| 3,818,507 | A | * | 6/1974 | Albrecht | 2/457 |
| 4,408,356 | A | | 10/1983 | Abrams | |
| 4,513,451 | A | * | 4/1985 | Brown | 2/69 |
| 4,576,087 | A | | 3/1986 | Wolfe | |
| 4,731,883 | A | | 3/1988 | Foster | |
| 4,897,886 | A | * | 2/1990 | Grilliot et al. | 2/81 |
| 5,001,783 | A | | 3/1991 | Grilliot et al. | |
| 5,101,511 | A | * | 4/1992 | Elverskog | 2/2.5 |
| 5,131,097 | A | * | 7/1992 | Grilliot et al. | 2/81 |
| 5,136,723 | A | * | 8/1992 | Aldridge et al. | 2/81 |
| 5,274,849 | A | | 1/1994 | Grilliot et al. | |
| 5,515,543 | A | | 5/1996 | Gioello | |
| 5,572,991 | A | | 11/1996 | Grilliot et al. | |
| 5,727,256 | A | | 3/1998 | Rudman | |
| 5,752,277 | A | | 5/1998 | Van der Sleesen | |
| 6,163,883 | A | | 12/2000 | Hong | |
| 6,263,510 | B1 | * | 7/2001 | Bay et al. | 2/93 |

FOREIGN PATENT DOCUMENTS

| | | | | |
|---|---|---|---|---|
| GB | 2 327 858 | * | 2/1999 | A41D/13/02 |
| TW | GB 2 104 770 | * | 3/1983 | A41D/27/28 |

* cited by examiner

*Primary Examiner*—Gary L. Welch
(74) *Attorney, Agent, or Firm*—Thompson Hine LLP

(57) ABSTRACT

A protective garment including a generally continuous outer shell and a moisture barrier located generally inside of the outer shell such that when the garment is worn, the moisture barrier is located generally between the outer shell and a wearer of the garment. The moisture barrier includes at least one vent such that at least part of the air located inside the moisture barrier can be vented outside of the moisture barrier.

44 Claims, 5 Drawing Sheets

VENTED PROTECTIVE GARMENT

BACKGROUND

The present invention relates to garments and, more particularly, to protective garments having a vent such as a vented moisture barrier.

Protective or hazardous duty garments and garment sets are widely used in various industries to protect the wearer from various hazardous conditions, such as heat, smoke, cold, sharp objects, chemicals, liquids, fumes and the like. Each protective garment may include an outer shell layer, a thermal barrier or thermal liner located inside the outer shell, and a moisture barrier located inside the outer shell. The moisture barrier may be semi-permeable such that the moisture barrier is generally liquid impermeable and generally moisture vapor permeable.

The moisture barrier may be located inside the outer shell to block moisture from the ambient environment from passing through the garment, while allowing moisture vapor inside the garment to pass through the moisture barrier. However, although the moisture barrier may be generally permeable to moisture vapor to allow moisture vapor to pass therethrough, moisture vapor may still remain trapped inside the garment. In particular, under heavy work conditions the moisture vapor generated by the wearer (for example, by perspiration) may be generated at a rate greater than that which the moisture barrier can pass therethrough. Accordingly, there is a need for a protective garment with an improved system for enabling the escape of moisture vapor.

SUMMARY

In one embodiment, the invention is a garment, such as a protective garment, which has a vented layer, such as a vented moisture barrier to allow moisture vapor to be vented out of the garment. In one embodiment, the invention is a protective garment including a generally continuous outer shell and a moisture barrier located generally inside of the outer shell such that when the garment is worn, the moisture barrier is located generally between the outer shell and a wearer of the garment. The moisture barrier includes at least one vent such that at least part of the air located inside the moisture barrier can be vented outside of the moisture barrier.

These and other objects and advantages of the present invention will be apparent from the following description, the accompanying drawings and the appended claims.

DETAILED DESCRIPTION

Figure 1:
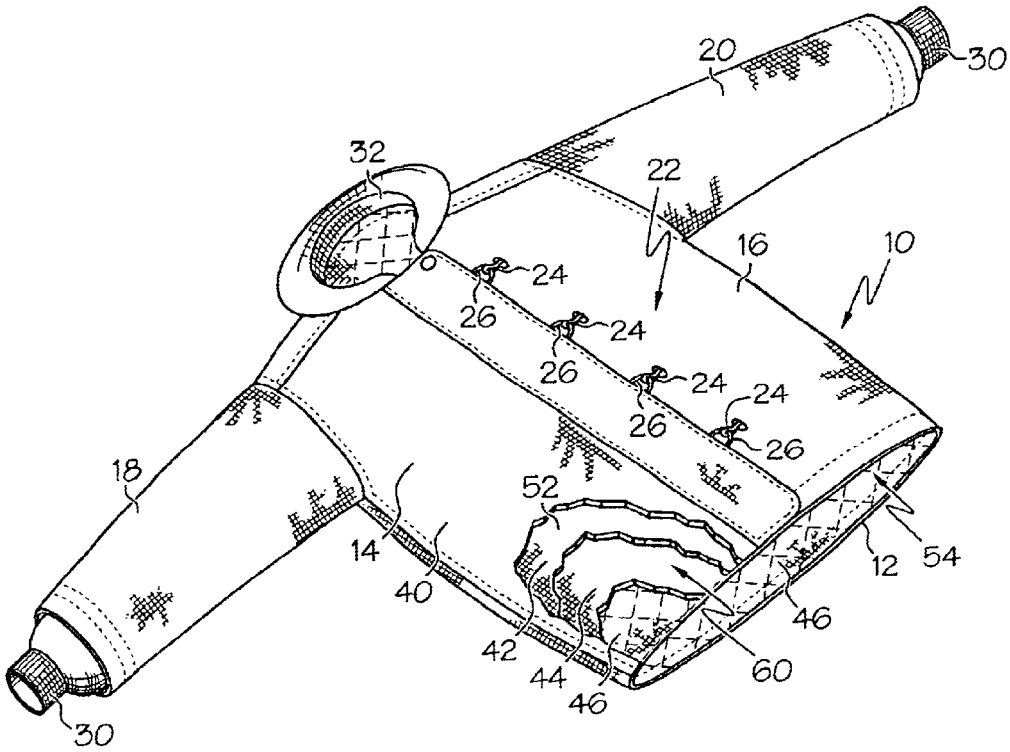
FIG. 1 is a front perspective view of one embodiment of a protective garment in the form of a turnout coat, with portions of the various layers of the garment cut away.

FIG. 1 illustrates a protective or hazardous duty garment in the form of a firefighter turnout coat, generally designated 10. The coat 10 may have aback panel 12, a left 14 and a right 16 front panel coupled to the back panel 12, and a pair of sleeves 18, 20 coupled to and extending generally outwardly from the back panel 12 and front panels 14, 16. The front panels 14, 16 may be permanently attached to the back panel 12 and sleeves 18, 20. The panels 14, 16 may be releasably attachable together by a fastening component, generally designated 22. In the illustrated embodiment, the fastening component 22 includes hooks 24 on the panel 16 which can cooperate with clasps 26 on the panel 14 to selectively close the coat 10. However, the fastening component 22 may include nearly any other fastener or fastening system, including but not limited to slide fastener components, snaps, zippers, buttons, hook and loop fastening systems, and the like.

The coat 10 may include a pair of knit wristlets 30 which may be made of an aramid material and located at the distal end of each sleeve 18, 20. The coat 10 may also include a collar 32 of an aramid material attached to the back panel 12 and front panels 14, 16.

The coat 10 may include various layers through the thickness of the garment, such as an outer shell 40, a moisture barrier 42 located inside of and adjacent to the outer shell 40, a thermal liner or barrier 44 located inside of and adjacent to the moisture barrier 42, and an inner liner or face cloth 46 located inside of and adjacent to the thermal liner 44. The outer shell 40 may be constructed of a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc.), and commercially available polybenzamidazole fibers including PBI fibers (a trademark of Celanese Corp.). Thus, the outer shell 14 may be an aramid material, a blend of aramid materials, a polybenzamidazole material, a blend of aramid and polybenzamidazole materials, or other appropriate materials, and may have a weight of, for example, between about 6–10 oz/yd$^2$.

The moisture barrier 42 and thermal liner 44 may be generally coextensive with the outer shell 40, or spaced slightly inwardly from the outer edges (i.e., the ends of the sleeves, the collar and the bottom edge) of the outer shell 40, to provide moisture and thermal protection throughout the coat 10. The moisture barrier 42 may include a semi-permeable membrane layer 50, which may be generally moisture vapor permeable but generally impermeable to liquid moisture. The membrane layer 50 may be made of or include expanded polytetrafluoroethylene ("PTFE") such as GORE-TEX or CROSSTECH (both of which are trademarks of W. L. Gore & Associates, Inc.), polyurethane-based materials, neoprene-based materials, cross-linked polymers, polyamid, or other materials. The membrane layer 50 may have microscopic openings that permit moisture vapor to pass therethrough, but block liquids from passing therethrough. The membrane layer 50 may be made of a microporous material that is either hydrophilic, hydrophobic, or somewhere in between. The membrane layer 50 may also be monolithic and may allow moisture vapor transmission therethrough by molecular diffusion. The membrane layer 50 may also be a combination of microporous and monolithic materials (known as a bicomponent moisture barrier), in which the microporous or monolithic material can be layered or intertwined.

The membrane layer 50 may be bonded or adhered to a substrate 52 (FIG. 2) of a flame and heat resistant material. The substrate 52 may be aramid fibers similar to the aramid fibers of the outer shell 40, but may be thinner and lighter in weight. The substrate 52 may be woven, non-woven, spunlace or other materials.

Figure 2:
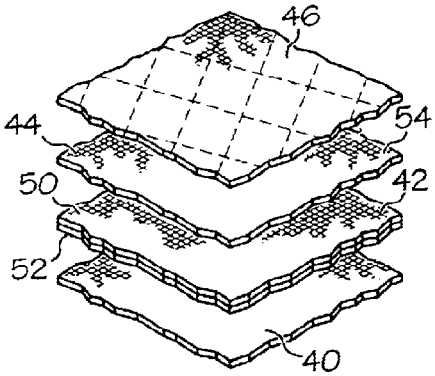
FIG. 2 is an exploded section view of the coat of FIG. 1.

In the orientation illustrated in FIGS. 1 and 2, the moisture barrier 42 may prevent moisture from the ambient environment from entering the inner cavity 54 of the coat 10 to keep the wearer dry and to prevent the thermal barrier 44 from absorbing moisture from the ambient environment. In the illustrated embodiment, the membrane layer 50 may face the inner portion of the coat 10 (i.e., face the thermal liner 44 or inner cavity 54), and the substrate 52 of the moisture barrier may face the outer portion of the coat 10 (i.e., face the outer shell 40).

The thermal liner 44 may be made of any suitable material which provides sufficient thermal insulation. In one embodiment, the thermal liner 44 may include a relatively thick (i.e. typically from 1/16"–3/16" thick) batting, felt or needled non-woven material 54 which can include aramid fiber batting (such as NOMEX batting), aramid needlepunch material, an aramid non-woven material, an aramid blend needlepunch material, an aramid blend batting material, an aramid blend non-woven material, or foam (either open or closed cell) materials. The batting 54 preferably traps air and possesses sufficient loft to provide thermal resistance to the garment 10. The batting 54 is typically quilted to the face cloth 46, and the thermal liner face cloth 46 may be a weave of a lightweight aramid material. Thus, either the batting 54 alone, or the batting 54 in combination with the face cloth 46, may be considered to be the thermal liner 44. In one embodiment, the thermal liner 44 may have a thermal protection performance ("TPP") of at least about 20, or of at least about 35. The thermal liner 44 may be treated with a water-resistant material. The face cloth 46 may be designed to be the innermost layer of the garment 10, 12, and can provide a comfortable surface for the wearer and protect the batting 54 from abrasion by the wearer.

Each layer of the coat 10, and the coat 10 as a whole, may be designed to meets the National Fire Protection Association ("N.F.P.A.") 1971 standards for protective firefighting garments ("Protective Clothing for Structural Firefighting"). The NFPA standards specify various minimum requirements for heat and flame resistance and tear strength. For example, in order to meet the NFPA standards, an outer shell 40 of a firefighter garment must be able to resist igniting, burning, melting, dripping and/or separation at a temperature of 500° F. for at least five minutes. Furthermore, in order to meet the NFPA standards, all combined layers of the garment 10 must provide a thermal protection performance rating of at least 35.

Figure 4:
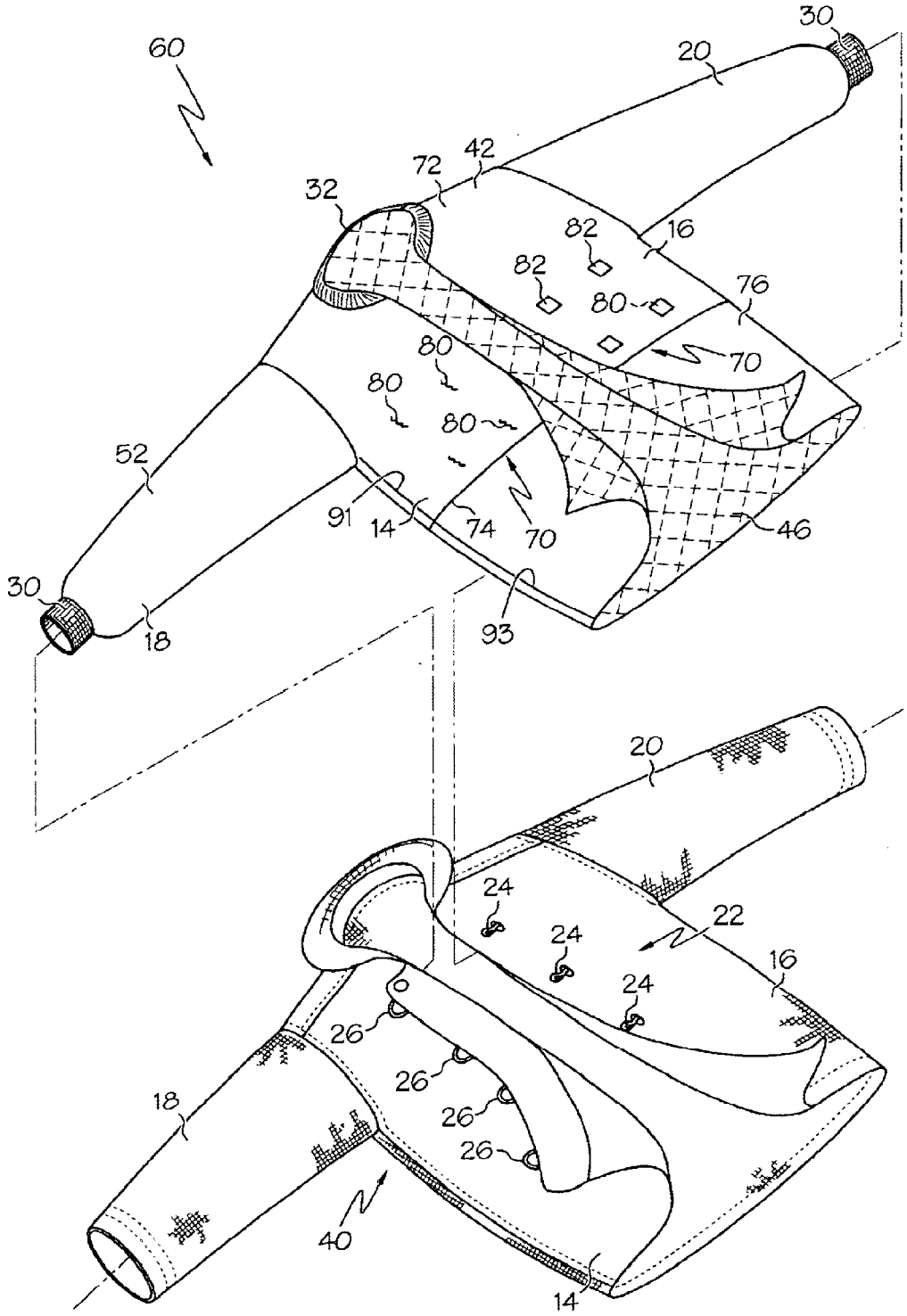
FIG. 4 is an exploded view of the coat of FIG. 1.
Figure 5:
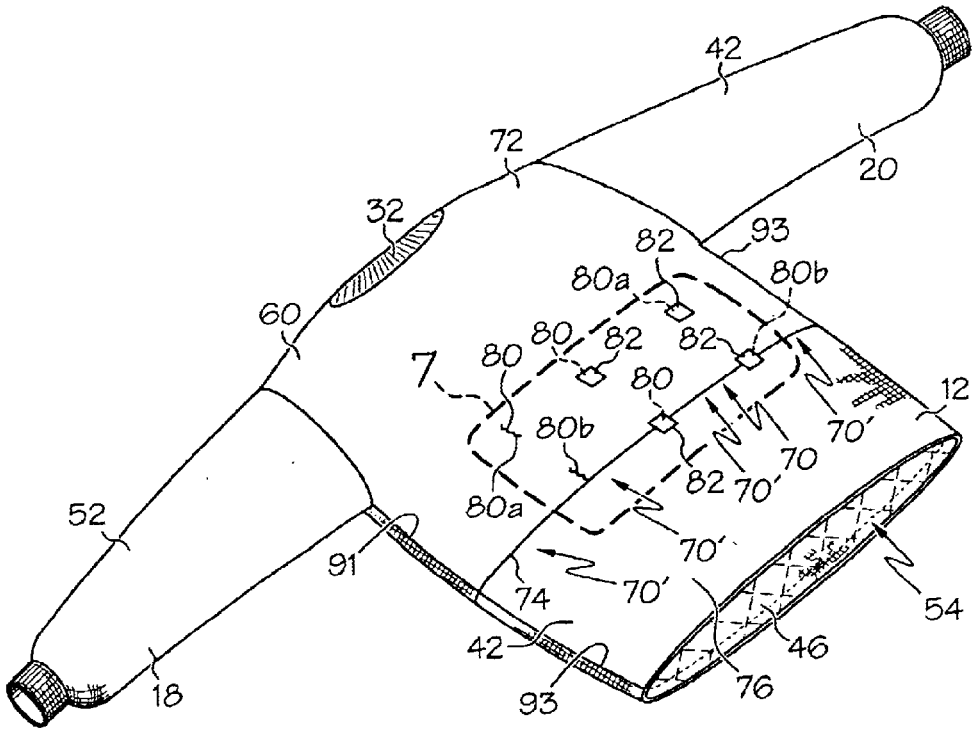
FIG. 5 is a back perspective view of the liner of the coat of FIG. 1.

The moisture barrier 42 and thermal liner 44 may be permanently attached to each other about their peripheries (or about their peripheries and interior), such as by stitching, so that the moisture barrier 42 and thermal liner 44 function as a unitary component of the garment 10. In this case, the moisture barrier 42 and thermal liner 44 may be referred to together as the inner liner 60 of the garment 10. In one embodiment, the moisture barrier 42 and thermal liner 44 can be combined into a removable inner liner 60. For example, FIG. 4 illustrates the inner liner 60 removed from the outer shell 40, and FIG. 5 illustrates a rear perspective view of the inner liner 60. However, it should be understood that FIGS. 4 and 5 are included primarily for illustrative purposes, and the inner liner 60 need not necessarily be removable from the outer shell 40, and the moisture barrier 42 and thermal liner 44 need not necessarily be coupled together to form an inner liner 60.

Various layers of the garment 10 may be vented to allow the rapid expulsion of air and/or moisture vapor from inside the garment 10. For example, as shown in FIGS. 4, 5, 7 and 8, the moisture barrier 42 may include a generally laterally-extending vent 70 extending around the periphery of the moisture barrier 42. The moisture barrier 42 may be formed by overlapping portions of the moisture barrier 42. For example, the moisture barrier 42 may include an upper portion 72 having a lower edge 74 and a lower portion 76 having an upper edge 78. The upper portion 72 may at least partially overlap with and be located outside of the overlapping portions of the lower portion 76. The thermal barrier 44 may not necessarily be vented (although it may be if so desired), and in the illustrated embodiment only the moisture barrier 42 is vented. Furthermore, in one embodiment the outer shell 40 may be generally continuous such that the outer shell 40 generally is not vented, although the outer shell 40 may be vented if desired.

As noted above, the vent 70 may be formed by overlapping the upper 72 and lower 76 portions of the moisture barrier 42. The upper 72 and lower 76 portions of the moisture barrier 42 may then be coupled together in a variety of manners. In one embodiment, the upper 72 and lower 76 portions are coupled together at a plurality of spaced locations to form discreet spaced vents 70'. For example, as shown in FIG. 5, the moisture barrier 42 may include a plurality (i.e. three) of vertically spaced pairs of stitched tacks 80 located on the back of the garment 10 to form four discreet vent openings 70'. As shown in FIG. 4, the garment 10 may also include a plurality of pairs of stitched tack locations 80 on the front of the garment 10. For example, the garment 10 may include four pairs of stitched tacks 80 on its front with two pairs of stitched tacks 80 being located on either side of the front slit or opening of the moisture barrier 42.

Each stitched tack 80 may include a few stitches or a small stitch line that extends through the overlapping portions of both the upper 72 and lower 76 portions of the moisture barrier 42 to coupled the upper 72 and lower 76 portions together. Each pair of stitched tacks 80 may include two generally vertically spaced stitched tacks, with the upper stitched tack 80*a* (FIGS. 7 and 8) being located adjacent to the top edge 78 of the lower portion 76 and each lower stitched tack 80*b* being located adjacent to the bottom edge 74 of the upper portion 72.

The stitched tacks 80 couple the upper 72 and lower 76 portions together to maintain the upper 72 and lower 76 portions in their desired orientation. For example, in the embodiment illustrated in FIGS. 5, 7 and 8, the overlapping portions of the upper portion 72 are located outside of the overlapping portions of the lower portion 76, and the stitched tacks 80 help to maintain the upper 72 and lower 76 portions in this orientation.

Figure 7:
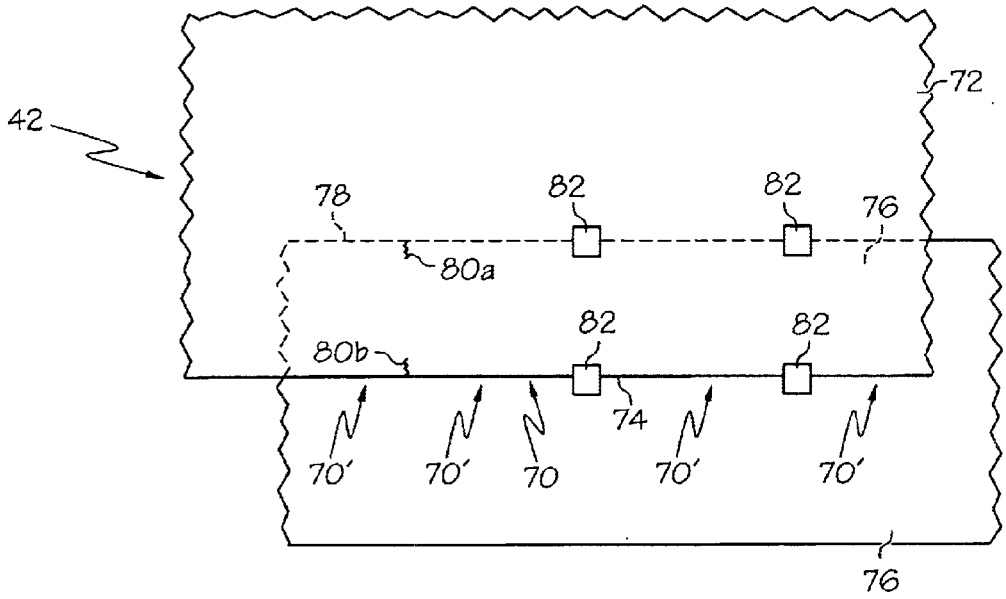
FIG. 7 is an outer view of a portion of a vented moisture barrier (i.e., a detail view of the area of the moisture barrier defined by lines 7—7 of FIG. 5)
Figure 8:
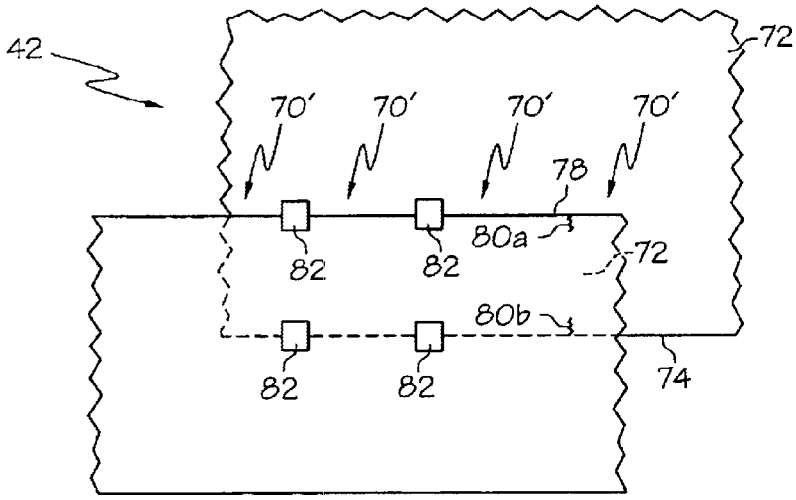
FIG. 8 is an inner view of the portion of the moisture barrier of FIG. 7.
Figure 9:
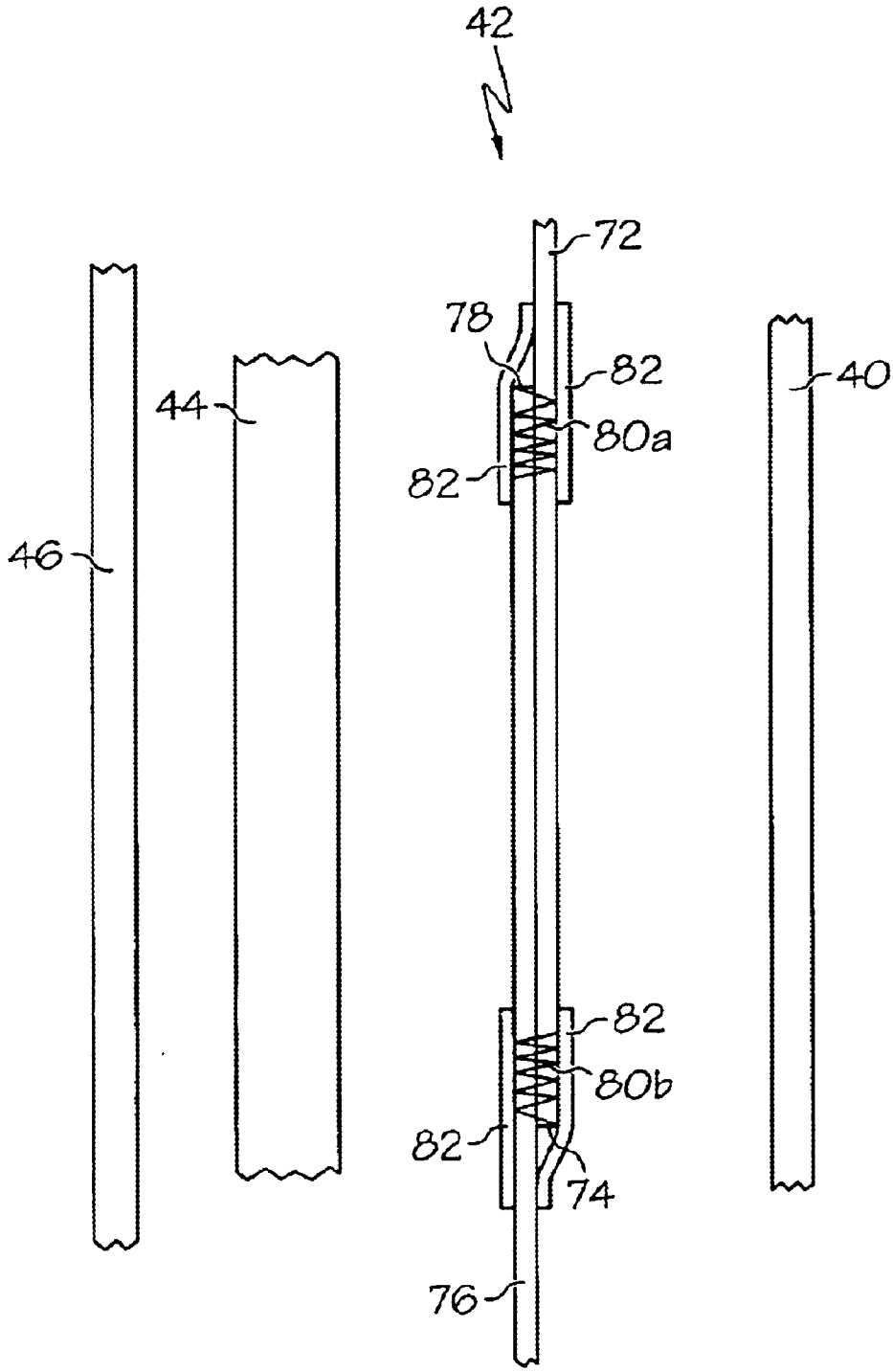
FIG. 9 is a side cross section of a portion of the coat of FIG. 1.

Each of the stitched tacks 80 may be covered with a sealant, such as a tape 82. FIGS. 5, 7 and 8 illustrate selected ones of the stitched tacks 80 on the back of the moisture barrier 42 (i.e., the two right-most pairs of tacks 80 as viewed from outside the garment 10) as being covered with the tape 82 and the left-most pair of tacks 80 are not covered with the tape 82 for illustrative purposes. Similarly, FIG. 4 illustrates the two right-most pairs of tacks 80 as being covered with tape 82, and the two left-most pairs of tacks 80 are not covered with the tape 82. However, it should be understood that all, none, or various combinations of the stitched tack 80 locations may be covered with the tape 82.

In one embodiment, the sealant is made of the same materials as the membrane 50 of the moisture barrier 42 with an adhesive applied thereto. Thus, the tape 82 may be, for example, a PTFE film, although the sealant can take a variety of other forms, includes sealants applied in a liquid form and cured into a solid. As shown in FIGS. 7 and 8, the tape 82 may be located on both sides of the stitched tack locations 80 (i.e., on both the outer and inner surfaces of the moisture barrier 42) to cover both the inner and outer surfaces of the stitched tacks 80. In this manner, the sealant 82 helps to seal the stitched tacks 80 to prevent fluids from passing through the stitched tacks 80 and the holes pierced in the moisture barrier 42 due to stitching. The use of stitched tacks 80 to couple the overlapping portions of the moisture barrier 42 provides a relatively low-area connection (as compared to, for example, a stitched line) so that the stitched tacks 80 can be more effectively sealed, and to present a lesser surface area for the infiltration of fluids.

The vent 70 formed by the upper 72 and lower 76 portions of the moisture barrier 42 enables relatively large volumes of air to be expelled through the vent 70, thereby enabling moisture vapor-laden air located inside the inner cavity 54 of the garment 10 to be expelled, such as by convection. The air in the inner cavity 54 of the coat can be expelled through the vent 70 by various forces, including by the movement of the wearer. For example, natural movements of the wearer, such as lifting, walking, crawling, etc. will cause billowing and deflation of the garment 10, thereby forcing air through the vent 70. The moisture-laden air may thereby be moved from the inner cavity 54 through the vent 70 and into the space between the outer shell 40 and moisture barrier 42. In this case, the moisture-laden air is spaced away from the thermal barrier 44, and the moisture-laden air can then work its way outside the garment 10. Thus, the vent 70 and outer shell 40 may be arranged such that there is generally no direct path from the outside of the garment 10 through the outer shell 40 to the inner cavity 54 or to inside of the moisture barrier 42.

Although the upper 72 and lower portions 76 may at least partially overlap, they need not necessarily overlap to form the vent 70. For example, a slit may be formed in the moisture barrier 42, and all that is required is that a slit, opening, hole or other vent be formed in the moisture barrier to allow air located inside the inner cavity 54 to be carried outside the moisture barrier 42. Furthermore, the vent 70 need not be a continuous slit, opening, hole or the like. The vent may be or include a plurality of discrete openings, such as those included in a mesh material or the like. However, the overlapping nature of the moisture barrier 42 may help to keep liquid moisture, such as liquid from the ambient environment, outside the inner cavity 54. The upper 72 and lower 76 portions may overlap by nearly any desired length, such as greater than about ½", between about ½" and about 6", or about 4". The vent 70 may be located at nearly any desired location along the vertical height of the coat 10, but may be located below the armholes of the garment.

As noted above, the stitched tacks 80 couple the upper 72 and lower 76 portions of the moisture barrier 42 together to maintain the upper 72 and lower 76 portions in their desired orientation. The stitched tacks 80 may extend generally horizontally, generally vertically, or in some other direction. Furthermore, the stitched tacks 80 may extend a relatively short distance along the height or width of the coat 10 or along the overlapping portions to ensure that the vent 70 or vents 70' remain open to ensure the free flow of air therethrough. Furthermore, because the vent 70 may extend around the entire perimeter or circumference of the moisture barrier 42 and/or garment 10, the entire inner cavity 54 can be effectively vented.

Figure 3:
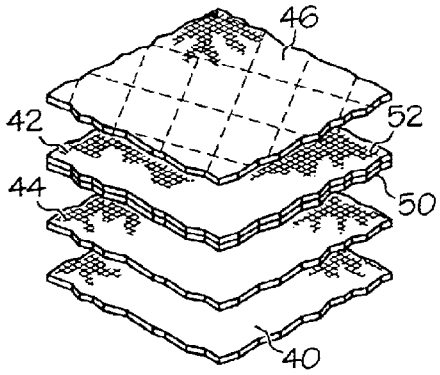
FIG. 3 is an exploded section view of another embodiment of the coat of FIG. 1.

In some cases, it may be desired to switch the orientation of the moisture barrier 42 and the thermal barrier 44. For example, as shown in FIG. 3 the moisture barrier 42 may be located inside of the thermal barrier 44. In this embodiment, the moisture barrier 42 can aid in preventing liquid moisture from inside of the garment 10 (such as liquid perspiration) from contacting and being absorbed by the thermal barrier 44. In this configuration, the membrane layer 50 of the moisture barrier 42 may face the outer portion of the coat 10, and the substrate 52 of the moisture barrier 42 may face the inner portion of the coat 10. In this case the moisture barrier 42 can be vented in a manner similar to the arrangement shown and discussed above, but the overlapping orientation of the upper 72 and lower 76 portions may be reversed. In other words, the overlapping part of the upper portion 72 may be located inside of the lower portion 76 to keep perspiration from reaching the thermal barrier 44. In this case, the vent 70 again helps to vent moisture-laden air outside of the inner cavity 54 to increase the comfort of the wearer.

Furthermore, the outer shell 40 and/or the thermal liner 44, as well as any other layers of the garment 10 besides or in addition to the moisture barrier 42, may also be vented. The outer shell 40, thermal liner 44, and other layers can be vented by overlapping the portions of the garment, as outlined above for the moisture barrier 42, or can be vented in various other manners (such as forming slits, openings, etc.). Furthermore, any one of the layers, or each of the layers, or various combinations of the layers may be vented as desired.

Additionally, the garment 10 need not necessarily include each of the outer shell 40, moisture barrier 42 or thermal liner 44. For example, the garment 10 may include only an outer shell 40 and moisture barrier 42, either of which or both of which may be vented. The garment 10 may also include only an outer shell 40 and a thermal liner 44, either of which or both of which may be vented. The garment 10 may also include only an outer shell 40 and a combined moisture barrier/thermal liner, either of which or both of which may be vented.

Figure 6:
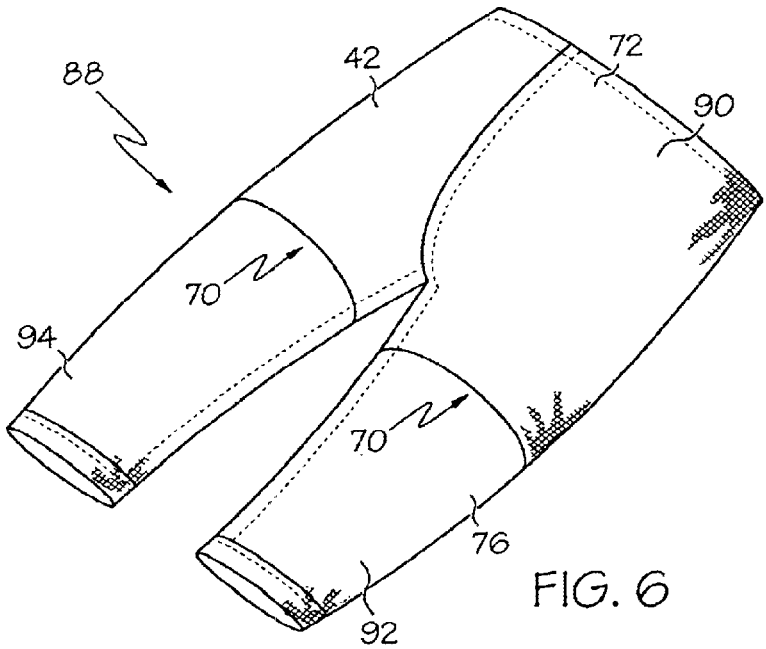
FIG. 6 is a front perspective view of the liner of a pair of pants.

As shown in FIG. 6, the vented arrangement, such as the vented moisture barrier may also be used in a pair of pants or trousers 88. The pants 88 may include an outer shell 40, thermal barrier 44 and moisture barrier 42 or other arrangement in the same manner as discussed above, and FIG. 6 illustrates the moisture barrier 42. The pants 88 may include an upper portion 90 and a pair of legs 92, 94 extending downwardly from the upper portion 90. The vents 70 of the moisture barrier 42 may be located at nearly any location of the pants 88, and in the illustrated embodiment are located in the upper portion of the legs 92, 94.

Furthermore, it should be understood that the vented layer or layers of the present invention is not limited to garments in the form of a turnout coat or pants. Although a coat 10 and pants 88 are illustrated herein, it should be readily apparent to one skilled in the art that the arrangement of the various layers of the garments shown and described herein is applicable to various other garments beyond the coat 10 and pants 88 specifically shown herein. The vented arrangement may also be applied to the jumpsuits, parka-style firefighter coats, coat and pant combinations, EMS garments, USAR (Urban Search And Rescue) garments and the like, without departing from the scope of the invention.

Various methods of assembling the garments disclosed herein may be used. In one embodiment, the material for the outer shell 40 is supplied in roll form, and patterns (i.e., in the case of the coat 10, patterns for the back panel 12, panels 14, 16 and sleeves 18, 20) are cut and sewn together to form the outer shell 40. The materials for the thermal liner 44 and moisture barrier 42 may also be provided in roll form, and the desired shapes can be stamped out of the rolls of material and formed into the desired shapes and configurations. The upper 72 and lower 76 portions of the moisture barrier 44 or other vented layers may then be joined, such as by overlapping the upper 72 and lower 76 portions and forming the stitch tacks 80 in the desired manner. The stitch tacks 80 may then be sealed with a sealant such as tape 82.

The thermal liner 44 and moisture barrier 42 may then be attached together, or each can be separately located inside the outer shell 40. Various methods of attaching the outer shell 40, thermal liner 44 and moisture barrier 42 together, such as the use of snaps, strips of hook and loop fastening material, stitching, adhesives and the like may be used.

As noted above, each portion 72, 76 of the moisture barrier 42 may be made from separate portions that are coupled together. For example, the torso portion of a typical non-vented moisture barrier 42 may be made from three portions that are coupled together by two stitched "side seams" that extend vertically along the moisture barrier 42 downwardly from the armholes. Thus, each portion 72, 76 of the moisture barrier 42 may include a similar construction and may include similar side seams (see, e.g. side seams 91, 93 of FIGS. 4 and 5). Although the overlapping portions 72, 76 of the moisture barrier 42 may be coupled along their side seams, the resultant connection or side seam may provide an area for moisture infiltration. In particular, a connection along the side seams is a relatively long connection which provides an increased area for moisture to pass, and at least partially closes part of the vent 70. Thus, it may be desirable to couple the portions 72, 76 of the moisture barrier 42 at locations other than the side seams. Of course, the portions 72,76 of the moisture barrier 42 may each be a unitary portion, and would therefore lack any side seams.

While the form of apparatus disclosed herein constitutes a preferred embodiment of the invention, it is to be understood that the present invention is not limited to this precise form of apparatus, and that variations and modifications may be made therein without departing from the scope of the invention.

What is claimed is:

1. A protective garment comprising:

a generally continuous outer shell; and a moisture barrier located generally inside of said outer shell such that when said garment is worn, said moisture barrier is located generally between said outer shell and a wearer of said garment, said moisture barrier including at least one vent extending through the entire thickness of said moisture barrier such that at least part of the air located inside said moisture barrier can be vented outside of said moisture barrier by said vent.

2. The garment of claim 1 wherein said moisture barrier is generally co-extensive with said outer shell.

3. The garment of claim 1 wherein said moisture barrier is generally entirely made of a material that is generally liquid impermeable and generally moisture vapor permeable.

4. The garment of claim 1 wherein said moisture barrier is made of a material that includes expanded polytetrafluoroethylene.

5. The garment of claim 1 wherein said garment is a turnout coat, and wherein said vent extends around substantially the entire perimeter of said moisture barrier of said coat.

6. The garment of claim 5 wherein said vent extends generally horizontally along at least the back of said moisture barrier.

7. The garment of claim 1 further comprising a thermal liner layer located generally inside said outer shell such that when said garment is worn said thermal liner is located generally between said outer shell and a wearer of said garment.

8. The garment of claim 7 wherein said moisture barrier is generally located between said outer shell and said thermal liner.

9. The garment of claim 7 wherein said thermal liner includes a material selected from a group consisting of an aramid needlepunch material, an aramid batting material, an aramid non-woven material, an aramid-blend needlepunch material, an aramid-blend batting material and an aramid-blend non-woven material.

10. The garment of claim 7 further comprising a face cloth layer located inside of said thermal liner and located to be the innermost layer of said garment.

11. The garment of claim 7 when said moisture barrier has a thickness less than said thermal liner.

12. The garment of claim 1 wherein said moisture barrier includes a first moisture barrier portion and a second moisture barrier portion, and wherein said first and second moisture barrier portions at least partially overlap to form said at least one vent.

13. The garment of claim 12 wherein said first moisture barrier portion is an upper portion and said second moisture barrier portion is a lower portion, and wherein said upper and lower portions overlap such that the overlapping portion of said upper moisture barrier portion is located generally outside of the overlapping portion of said lower moisture barrier portion.

14. The garment of claim 12 wherein said first moisture barrier portion and said second moisture barrier portion are coupled together at a plurality of spaced locations.

15. The garment of claim 14 wherein said first moisture barrier portion and said second moisture barrier portion are coupled together by a plurality of stitched tacks.

16. The garment of claim 15 wherein each of said stitched tacks extend for a distance less than the length of the overlap of said first and second moisture barrier portions.

17. The garment of claim 15 wherein each stitched tack is covered by a sealant on both sides of said stitched tack.

18. The garment of claim 1 wherein said garment is shaped to fit about a wearer, and wherein said vent is located on a portion of said garment that is shaped to be located adjacent a torso of said wearer.

19. The garment of claim 1 wherein said outer shell is abrasion, flame and heat resistant.

20. The garment of claim 1 wherein said outer shell includes a material selected from a group consisting of an aramid material, a blend of aramid materials, a polybenzamidazole material, and a blend of aramid and polybenzamidazole materials.

21. The garment of claim 1 wherein said vent enables moisture to be vented to the space located between said outer shell and said moisture barrier.

22. The garment of claim 1 wherein said moisture barrier include an outer perimeter, and wherein said vent includes an opening formed through the entire thickness of the moisture barrier that is entirely spaced away from said outer perimeter.

23. The garment of claim 1 wherein said moisture barrier is generally continuous.

24. A protective garment comprising:

an outer shell; and a moisture barrier located generally inside of said outer shell such that when said garment is worn, said moisture barrier is located generally between said outer shell and a wearer of said garment, said moisture barrier being generally co-extensive with said outer shell and including at least one vent such that said vent generally communicates with the space between said outer shell and said moisture barrier.

25. The garment of claim 24 wherein said moisture barrier is generally co-extensive with said outer shell and is made of a material that is generally liquid impermeable and generally moisture vapor permeable.

26. The garment of claim 24 wherein said moisture barrier is generally continuous.

27. A protective garment comprising:

an outer shell; and a moisture barrier located generally inside of said outer shell such that when said garment is worn, said moisture barrier is located generally between said outer shell and a wearer of said garment, said moisture barrier being generally co-extensive with said outer shell and including at least one vent extending through the entire thickness of said moisture barrier and being configured such that there is generally no direct path from the outside of said garment through said outer shell to inside of the moisture barrier.

28. The garment of claim 27 wherein said moisture barrier is generally co-extensive with said outer shell and is generally entirely made of a material that is generally liquid impermeable and generally moisture vapor permeable.

29. The garment of claim 27 wherein said moisture barrier include an outer perimeter, and wherein said vent includes and opening formed through the entire thickness of the moisture barrier that is entirely spaced away from said outer perimeter.

30. The garment of claim 27 wherein said moisture barrier is generally continuous.

31. A protective garment comprising:

an outer shell; and a moisture barrier located generally inside of said outer shell such that when said garment is worn, said moisture barrier is located generally between said outer shell and a wearer of said garment, said moisture barrier being generally co-extensive with said outer shell, wherein at least one of said outer shell or said moisture barrier includes at least one vent extending through the entire thickness of said outer shell or moisture barrier such that at least part of the air located inside said at least one of said outer shell or moisture barrier can be vented outside of said one of said outer shell or moisture barrier by said vent.

32. The garment of claim 31 wherein said moisture barrier is generally co-extensive with said outer shell and is generally entirely made of a material that is generally liquid impermeable and generally moisture vapor permeable.

33. The garment of claim 31 wherein the other one of said outer shell or said moisture barrier is generally continuous and does not include a vent.

34. The garment of claim 31 wherein both of said outer shell and said moisture barrier include vents.

35. The garment of claim 31 wherein said moisture barrier include an outer perimeter, and wherein said vent includes an opening formed through the entire thickness of the moisture barrier that is entirely spaced away from said outer perimeter.

36. The garment of claim 31 wherein said moisture barrier is generally continuous.

37. A protective garment comprising:

an outer shell;

a moisture barrier located generally inside of said outer shell such that when said garment is worn, said moisture barrier is located generally between said outer shell and a wearer of said garment, said moisture barrier being generally co-extensive with said outer shell; and a thermal liner located generally inside of said outer shell such that when said garment is worn, said thermal liner is located generally between said outer shell and a wearer of said garment, said thermal liner being generally co-extensive with said outer shell, wherein at least one of said outer shell, moisture barrier or thermal liner includes at least one vent extending through the entire thickness of said one of said outer shell, moisture barrier or thermal liner such that at least part of the air located inside said one of said outer shell, moisture barrier or thermal liner can be vented outside of said one of said outer shell, moisture barrier or thermal liner by said vent.

38. The garment of 37 wherein said moisture barrier include an outer perimeter, and wherein said vent includes an opening formed through the entire thickness of the moisture barrier that is entirely spaced away from said outer perimeter.

39. The garment of claim 37 wherein said moisture barrier is generally continuous.

40. The garment of claim 37 wherein said moisture barrier has a thickness less than the thermal liner.

41. A method for assembling a garment comprising the steps of:

providing a generally continuous outer shell; and locating a moisture barrier generally inside of said outer shell such that when said garment is worn said moisture barrier is located generally between said outer shell and a wearer of said garment, said moisture barrier including at least one vent extending through the entire thickness of said moisture barrier such that at least part of the air located inside said moisture barrier can be vented outside of said moisture barrier.

42. The method of claim 41 wherein said moisture barrier include an outer perimeter, and wherein said vent includes an opening formed through the entire thickness of the moisture barrier that is entirely spaced away from said outer perimeter.

43. The method of claim 41 wherein said moisture barrier is generally continuous.

44. A protective garment comprising:

a generally continuous outer shell; and a moisture barrier located generally inside of said outer shell such that when said garment is worn said moisture barrier is located generally between said outer shell and a wearer of said garment, said moisture barrier being generally entirely made of a material that is generally liquid impermeable and generally moisture vapor permeable, said moisture barrier including at least one vent such that at least part of the air located inside said moisture barrier can be vented outside of said moisture barrier by said vent.

* * * * *